United States Patent [19]

Saalasti

[11] 4,192,088

[45] Mar. 11, 1980

[54] LUMP PEAT MACHINE

[75] Inventor: Tapio Saalasti, Helsinki, Finland

[73] Assignee: Kemi Oy, Kemi, Finland

[21] Appl. No.: 882,590

[22] Filed: Mar. 2, 1978

[30] Foreign Application Priority Data

Mar. 3, 1977 [FI] Finland ..... 770679

[51] Int. Cl.[2] ..... E21C 49/00

[52] U.S. Cl. ..... 37/3; 172/3; 172/7

[58] Field of Search ..... 37/3; 172/3, 7, 8

[56] References Cited

U.S. PATENT DOCUMENTS 880,061 2/1908 Anderson ..... 172/3 UX 1,117,263 11/1914 Shute ..... 172/3

FOREIGN PATENT DOCUMENTS 120496 10/1958 U.S.S.R. ..... 37/3

*Primary Examiner*—Clifford D. Crowder

*Attorney, Agent, or Firm*—Lyon & Lyon

[57] ABSTRACT

A lump peat machine mills peat by means of a rotating cutter which delivers the peat to a tube containing a screw conveyor for expression through a nozzle onto the ground. The cutter is raised and lowered through means of a hollow arm supporting the cutter at one end and mounted on the tube by means of an encircling bearing at the other end. The power train for the cutter is positioned within the hollow arm.

21 Claims, 4 Drawing Figures

LUMP PEAT MACHINE

Figure 1:
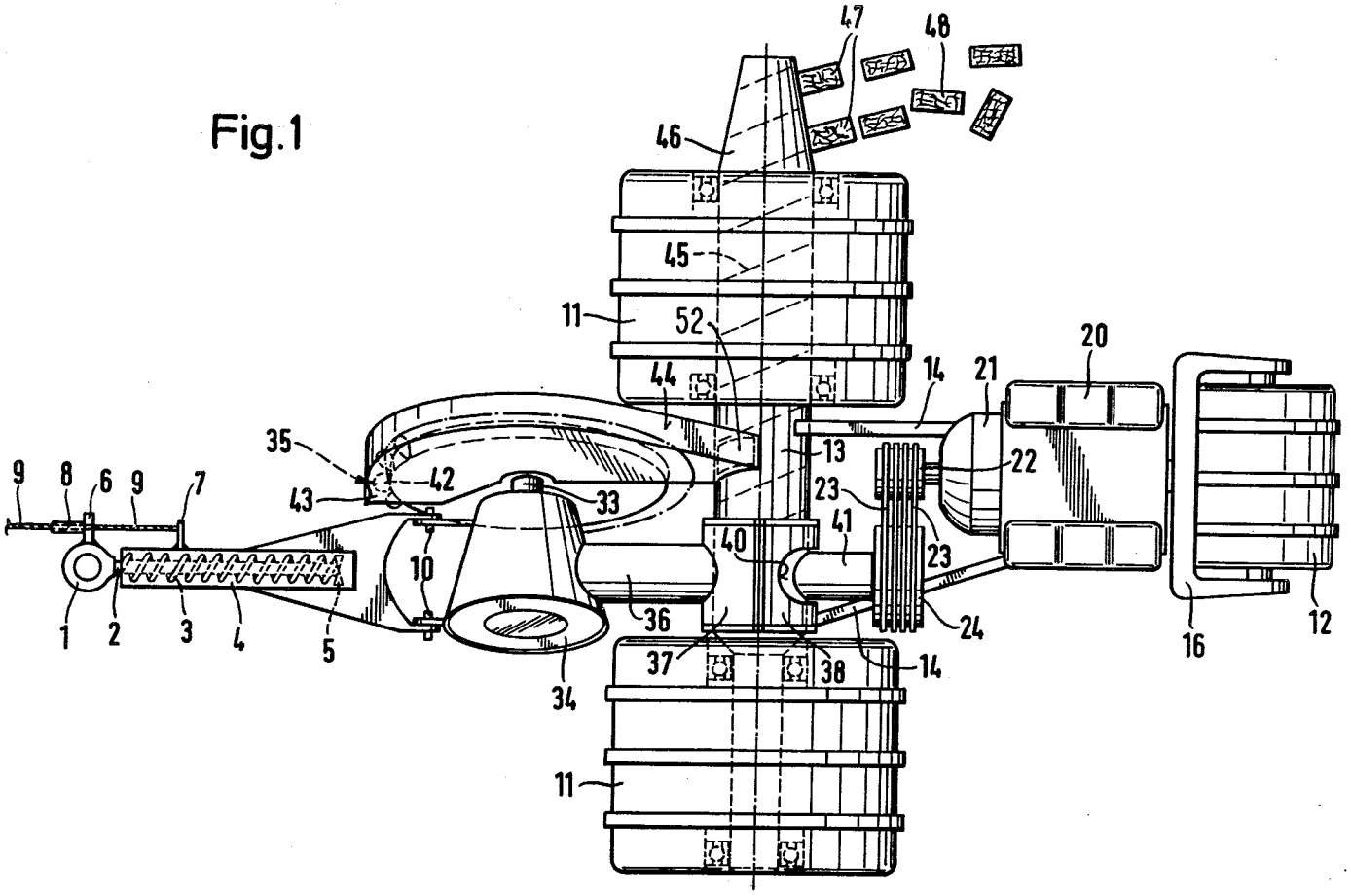

The present invention concerns a lump peat machine which as it travels mills peat from peatland and expresses the peat through orifices to lie on the ground beside its path and to dry there. The lump peat machine may be provided with its own propagating engine or it may be towed behind a tractor.

The lump peat machine has a milling cutter having, in practice, a diameter more than one meter. The cutter is able to produce by milling a furrow about 50 cm deep in the peat soil and it gathers peat simultaneously from greater depth as well as from the surface. There is wet peat in the depth and dry peat on the surface, and these are mixed as the machine works. It is possible by adjusting the milling depth, to obtain pressed lump peat with desired moisture content.

The lump peat machine requires power not only for its propagation but also for rotating the milling head and for driving the feed screw which serves to press the milled peat into lumps. Since rather much power is needed for the two last-mentioned operations if a satisfactory result is to be achieved, it is advantageous to furnish the lump peat machine with a separate power source even in that case in which it is towed by a tractor, from which power take-off to the milling cutter and feed screw would be possible.

In the prior art such lump peat machines are known which are either small machines meant to be directly attached to the lifting arms and power transmission of a tractor, or bigger machines which are rather complicated as regards power transmission. The small machines for direct coupling with the tractor have such low power that they are not economical enough in the producing of lump peat. Of the bigger machine types there may be mentioned a Russian lump peat machine which is in use in Finland: this machine is towed by a tractor and derives its power from the tractor. However, in this machine the power transmission to the milling cutter and to the feed screw is an expensive construction, owing to numerous gear wheels and shafts. The great number of components also detracts from the reliability in service. It is also a fact that the maintenance costs more than that of a machine with fewer components, which may moreover be made very strong and durable because they are few.

By the design taught by the present invention it is possible to manage with five gears and four shafts, instead of nine gears and six shafts in the Russian machine.

Although this design of prior art is simple for the reason that the lump peat machine itself needs no prime mover, a remarkable detrimental factor is introduced at the same time. The tractor, and particularly a caterpillar tractor, has a rather high weight. The weight of a caterpillar tractor is about 5 to 9 tons, while the weight of the lump peat machine itself is no more than 1.5 to 2 tons. When the milling cutter of the lump peat machine hits a stone or a big log, this results in breakage of the transmission and sometimes of the whole lump peat machine. Even minor damage necessitates repairs and a break in the work at all events. The summer is short in Finland, for instance: only 2 to 3 months. Therefore the machine should operate as efficiently as possible, so that at least two lump peat harvests per summer might be obtained.

The object of the present invention is to provide a lump peat machine which is not damaged if the milling cutter hits a stone, instead of which the engine remains running while the cutter stops. The milling cutter of the machine is able to saw or mill through even the thickest tree trunks found in the bog.

This object is attained by the aid of the characteristic features defined in the attached claims.

In the following the construction of the machine shall be described and elucidated with the aid of principle diagrams and an embodiment shall be presented, without in any way tying the invention to particularly this embodiment.

The design and construction of the lump peat machine is shown in the following principle diagrams.

Figure 2:
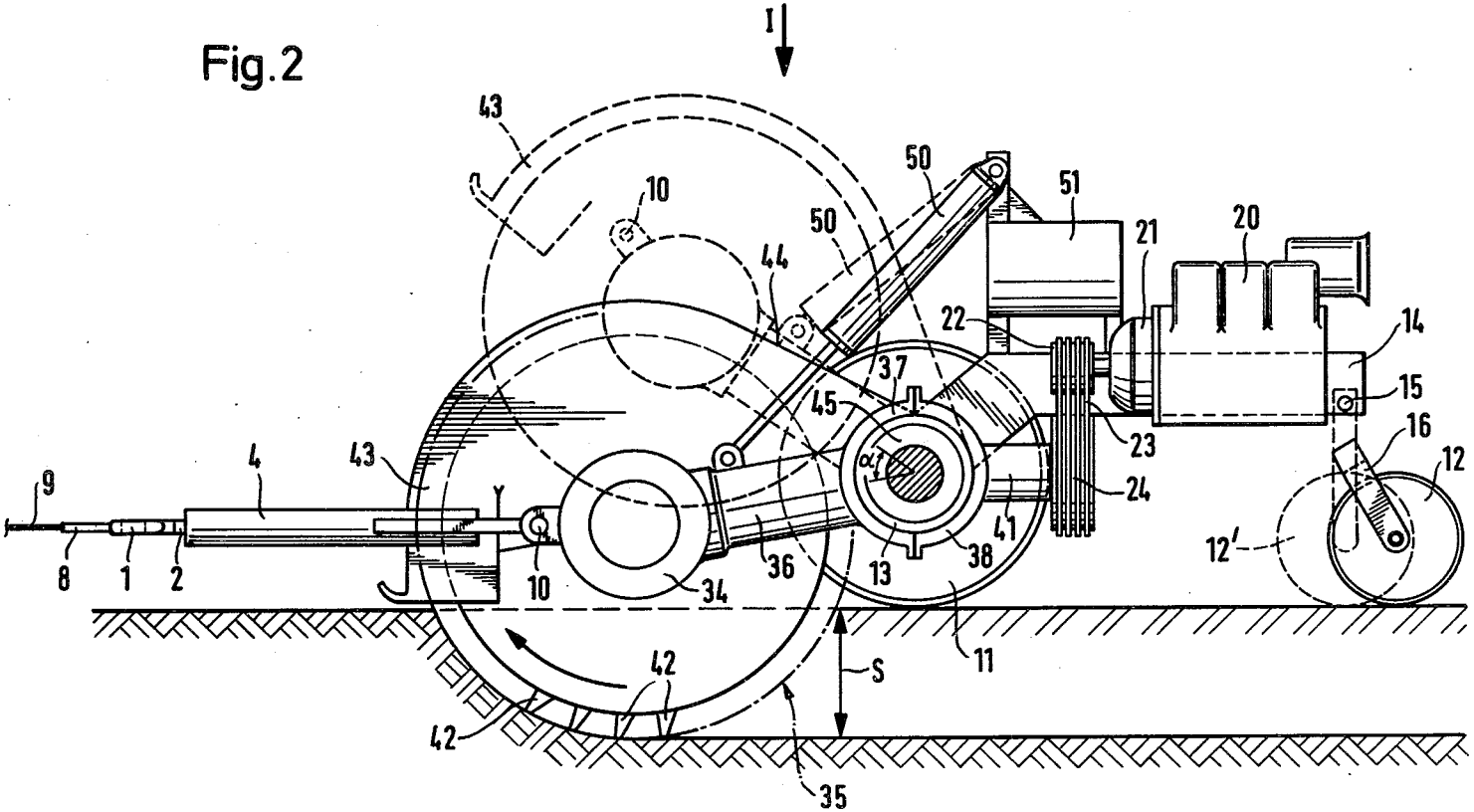

FIG. 1 shows the lump peat machine viewed from above,

FIG. 2 in elevational view, and

Figure 3:
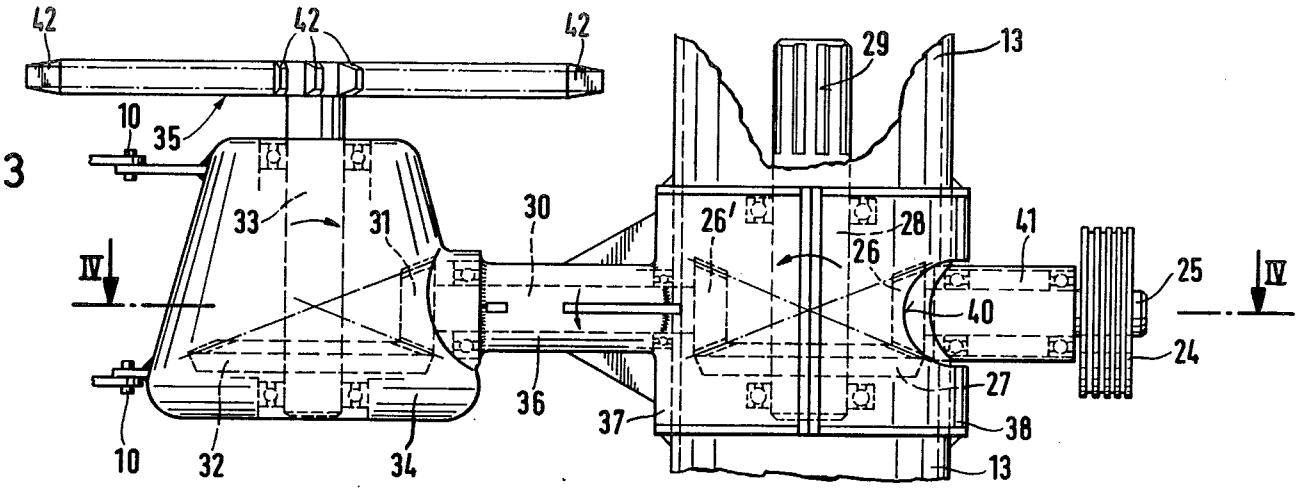
Figure 4:
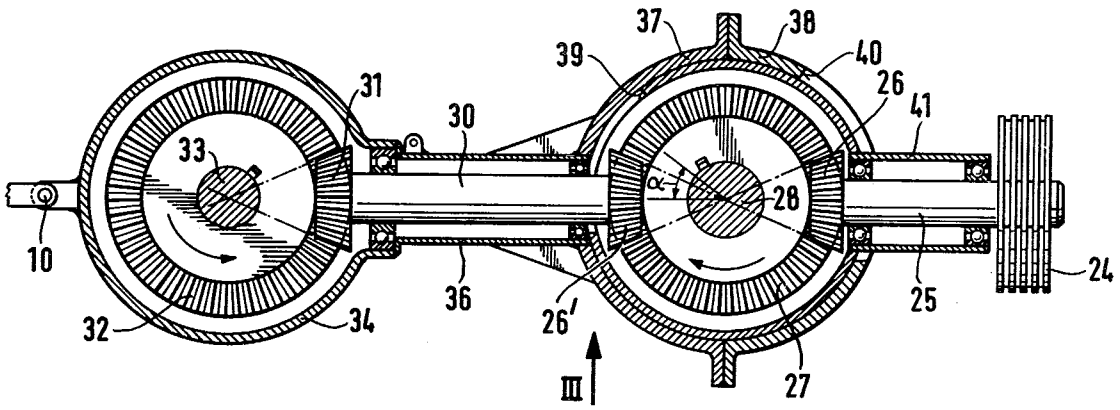

FIG. 3 illustrates the power transmission of the lump peat machine in top view and FIG. 4 in elevational view.

The most essential components are:

FIG. 1 represents a lump peat machine for towing behind a tractor. Component 1 is a traction loop, affixed to the pull bar 2. The pull bar is a rod about 1.2 m long and encircled by the traction spring 3. This spring, in its turn, is housed within the spring tube 4. The relative motion between th pull bar and spring tube has been damped with the aid of the friction coupling 5 so that minor force fluctuations of 50 to 100 kg do not continuously cause relative movements between the traction loop and the spring tube 4. The traction loop carries a lug 6 and likewise the spring tube carries the lug 7. From the lug 6 a flexible tube 8 has been carried into contiguity with the gas lever of the traction machine, and within which a flexible steel wire 9 is movable. This elastic unit with its flexible tube has been attached by pivots 10 to the lump peat machine proper. We shall later return to the operation of the elastic unit.

The carrying part of the lump peat machine consists of the drums, or wheels, 11 having a breadth and diameter determined by how soft is the peatland on which one desires to run the machine. The lump peat machine may be designed to have two wheels so that these two drums carry the entire structure, in which case the engine has been mounted above the tube serving as axle for the drums. Forward of the drum axle there has been integrally connected to the axle, a frame on which the traction unit with its elastic unit has been mounted. The lump peat machine may also have a design like that depicted in FIG. 1, in which case the machine has third, automatically trailing rear wheel 12, and to the axle tube 13 of the wheels 11 there has been affixed a frame 14, on the rear end of which (FIG. 2) a fork 16 has been rotatably carried with a bearing 15. Between the lower ends of this fork, the axle for the wheel 12 is mounted.

Upon the frame 14 the power unit has been mounted, for instance a diesel engine, component 20. Since quite often in peatland regions the water is corrosive, most appropriately an air-cooled diesel is used so that no radiator and no cooling water are needed. Attached to the flywheel of the diesel engine is a hydraulic coupling 21, which has been so dimensioned that the V-belt pulley 22 mounted on the shaft carrying the coupling may stop in the event of overload, while the diesel engine remains running. Transmission from the V-belt pulley is by V belts 23 to the lower V-belt pulley 24. This, in turn, drives a shaft 25 fixedly carried in the axle tube 13, FIG. 4. Within the axle tube 13 at the end of the shaft 25 there is a small bevel gear 26, driving a large bevel gear 27. This large bevel gear is mounted on the shaft continuation 28 of the screw, FIG. 3, which has been carried within the axle tube 13, and the end adjacent to the screw of this screw shaft continuation carries splines 29 so that the sleeve on the end of the feed screw fits these splines. The feed screw rotates at the same speed as the shaft 28, FIG. 3. Simultaneously, while the large bevel gear rotates and drives the shaft 28, it also drives a second small bevel gear 26', this gear in its turn driving over the shaft 30 and the small bevel gear 31, the cup wheel 32 of the milling cutter, FIG. 3. This cup wheel has been mounted on the shaft 33. This shaft is fixedly carried in the housing 34, and to the end of the shaft the milling cutter 35 has been affixed. The shaft 33 of the milling cutter can be tilted about the drive shaft 30 within arm 36 as a tilting axis such that the cutter and the slit it mills in the peat bog are inclined from the vertical at a suitable angle such as, for example, 15°. We shall return to the operation of the milling cutter later.

The housing 34 connects by the tubular arm 36 integrally with the large half-bearing 37, FIG. 4. The half-bearings 37 and 38 constitute a bearing turning about the tube 13 so that the milling cutter and its housing 34 may be raised into the upper position with the aid of a hydraulic cylinder 50, FIG. 2. When the arm 36 turns upwardly, the gear wheel 26' rotates along on the large bevel gear 27 and the shaft 30 is enabled to rise upwardly in the cut-out 39 of the tube 13, FIG. 4. The other half-bearing 38 similarly carries a cut-out 40 so that the bearing housing 41 integral with the tube 13, FIG. 3, has the freedom of a space consistent with the angular displacement $\alpha$. As can be seen from FIGS. 3 and 4, this design of the transmission is exceedingly simple. It has only, if the diameters are suitably selected, two types of gears and these gears too number only five, all told. Therefore the transmission, being simple, may also be built sturdy enough to ensure that in the event of the milling cutter 35 abruptly stopping against a thick log, a stone or another obstacle the transmission will not be damaged, but that instead the hydraulic coupling 21 shown in FIG. 1 allows the transmission means to stop and the engine remains running without incurring any damage.

We now return to the operation of the milling cutter. The milling cutter has such a large diameter that a milling depth such as is required for producing lump peat is reached, that is, the requisite amount of wet peat found at greater depth is admixed to the surface peat as the knives 42 on the outer circumference of the milling cutter, FIG. 2, cut fine slices of the peat and transport them upward within the guide 43. This guide encircles the front and top part of the milling cutter and constitutes the top and back wall 44 of a guide connecting with the tube 13, FIG. 2, so that the peat carried along with the milling cutter will pass in a continuous jet in through an aperture 52 of the tube 13, to the screw conveyor 45. The screw conveyor transports the peat through the hub of the wheel 11 into the pressure cone 46, mincing the peat at the same time. Since the cone tapers down, peat will be expressed through all nozzles with approximately equal pressure. After emerging, the lump peat falls down and breaks up into pieces, and the bog surface will be covered, in practice, with pieces of lump peat, 48, having about 80 to 100 mm diameter and about 15–20–30 cm length, FIG. 1. Owing to the principle of operation of the machine these pieces present a rather uniform, homogeneous quality of peat; their water content is about 80%, and upon drying they constitute very hard and durable lump peat blocks.

When making lump peat, it is usual practice to drive straight, long runs. In many instances these peat runs have a length up to 2–3 km. Whatever the length, there comes the time when the run ends and the machine has to be turned in a new direction. To accomplish this, one has to lift the milling cutter up. Raising of the milling cutter is accomplished in that from the hydraulic pump on the traction unit pressure is conducted into the lifting cylinder 50. In FIG. 2, the lifting cylinder has been indicated with dotted lines with the milling cutter in raised position, and with solid lines in the case that the milling cutter has been lowered. By conducting pressurized oil in under the piston of the cylinder, the milling cutter 35 can be lifted into the raised position, by manoeuvering from the towing unit. In that connection the traction assembly with its traction spring, 1–9, also rises at its rear end, but the lump peat machine is not very heavy to tow and will therefore follow along even though the rear end of the traction assembly is somewhat elevated. The upper end of the lifting cylinder has been attached to the frame 14 of the lump peat machine, and this frame also carries the fuel tank 51, FIG. 2.

The components of the lump peat machine have now been described as regards their main features. The following is a description of the machine's operation. When the traction machine pulls on the loop 1, the tension spring 3 will elongate to a certain point, depending on the hardness of the peatland nd on the driving speed. The resistance from the lump peat machine and the force of the spring are then equal. Thus the work proceeds with a given speed, say, 1km/h. During such operation the end of the steel wire 9 does not touch the gas lever of the towing machine. If the milling cutter 35 meets within the bog an obstacle, for instance a comparatively large bough or tree trunk, the heavy towing machine naturally continues its travel by kinetic energy, and the spring 3 comes under greater tension. Hereby the steel wire 9 first reduces the output of the diesel engine and ultimately causes it to idle, whereby the towing unit stops. The spring 3 may then have been elongated e.g. 30 cm. Although the towing machine has come to a standstill, the tension spring 3 still pulls the lump peat machine towards the towing unit, and at the same time the milling cutter 35 works its way through the bough or stump in its way. The engine 20 has been so regulated that its governor tends to maintain a given r.p.m. speed at all times. In other words, the torque of the engine increases until the engine works under full load. As soon as the obstacle within the bog has been milled through, the tension spring 3 is elongated and the steel wire 9 sets the gas lever of the towing machine free, and the towing machine starts forward once again with normal speed.

If, again, the milling cutter 35 encounters a stone, a steel cable or another similar obstacle which altogether prohibits its rotation even with maximum torque, the transmission means will stop and the engine remains running under full load. The tension spring 3 comes under tension at the same time and the towing machine becomes stationary, that is, in this case too, the big mass of the towing machine cannot pull the lump peat machine with force so that the milling cutter or other components thereof might be damaged. This is taken care of by the tension spring 3.

We may say with good reason that the lump peat machine of the invention thinks for itself and resolves what to do in different contingencies so that normal operations, that is the manufacturing of lump peat, might continue with the highest possible speed in spite of various obstacles. We may apply this as follows, for instance. If the towing prime mover has a strong enough engine, power transfer therefrom to the lump peat engine may be accomplished, for instance, in that the diesel engine is replaced with an electric motor and the towing machine carries a generator. Power transfer from the towing machine to the lump peat machine, which would be one with only two wheels in this case, goes on constantly in spite of the fact that the tension spring may be elongated more or less strongly. The same is true in the case of mechanical power transfer. If one uses acardan shaft and thereon a long enough splined shaft so that it affords a chance for power transfer even while the tension spring 3 works, the service reliability feature of the present invention is obtained in this way as well.

In the case of machines having three or four wheels and provided with an engine of their own, and which thus are not towed, the reliability feature of the present invention is achieved as follows, for instance. Power transmission is carried from the engine 20 over the fork 16 to the rear wheel 12, FIG. 2. In that case, naturally, a driver's seat and controls are provided behind the engine, over the wheel 12, and the wheels 12 push the leading lump peat machine before them. In that case the manoeuvering of the hydraulic cylinder 50 also takes place from the driver's cab or seat on top of the wheel 12. This design has the further advantage that the operator of the lump peat machine always has full vision straight ahead. Below in front is the milling disk, and in front to the right the pieces of lump peat emerging from the nozzles can be seen.

If in this modification the milling cutters hits an obstacle, such as a tree, the wheel 12 will proceed into the position 12' and the angle enclosed by the pivot pin 15 with the fork 16 will change, and the spring in the upper part of the fork 16 will be set under tension. When now the wheel 12 moves forward as the spring becomes more taut, a mechanical linkage acts directly on the transmission of the wheel 12, stopping the wheel. The spring, in its turn, pushes the lump peat machine and the milling cutter forward and the cutter does its milling equally as when the towed machine stops. Thus, the principle is the same and merely the embodiment is different.

I claim:

1. In a lump peat machine which mills peat from peatland by a rotating milling cutter which delivers milled peat to a tube having a screw conveyor disposed therein to express the peat through a nozzle to the surface, the improvement comprising means for raising and lowering the milling cutter comprising a hollow arm supporting said milling cutter at one end and affixed to a bearing at the other end, said bearing encircling said tube and being adapted to permit raising or lowering of said milling cutter between working and transport positions and means within said hollow arm to transmit power to said milling cutter.

2. A lump peat machine according to claim 1 wherein the means for transmitting power to said milling cutter comprise:

(a) a rotatable shaft within the hollow arm, (b) first and second bevel gears disposed at either end of said rotatable shaft, (c) a third bevel gear operatively connected to a power source and adapted to engage said first bevel gear to turn said shaft, (d) a fourth bevel gear operatively connected to the milling cutter adapted to engage the second bevel gear whereupon rotation of said shaft drives the milling cutter.

3. A lump peat machine according to claim 2 wherein a shaft connects said third bevel gear to the screw conveyor whereupon driving of said third bevel gear turns the screw conveyor.

4. A lump peat machine according to claim 3 wherein said third bevel gear is connected to the power source through a second rotatable shaft having at one end a fifth bevel gear adapted to engage said third bevel gear whereupon rotation of said second shaft by the power source drives said third bevel gear.

5. A lump peat machine according to claim 4 wherein said first and fifth bevel gears are the same size.

6. A lump peat machine according to claim 5 wherein the first, third and fifth bevel gears are located within the hollow tube.

7. A lump peat machine according to claim 2 wherein said third bevel gear is connected to the power source through a second rotatable shaft having at one end a fifth bevel gear adapted to engage said third bevel gear whereupon rotation of said second shaft by the power source drives said third bevel gear.

8. A lump peat machine according to claim 7 wherein said first and fifth bevel gears are the same size.

9. A lump peat machine according to claim 2 wherein the milling cutter is connected to the fourth bevel gear by a shaft.

10. A lump peat machine according to claim 9 wherein the milling cutter is disposed on the shaft from said fourth bevel gear at an angle inclined from a vertical plane defined by the axis of said hollow arm and the peat surface.

11. A lump peat machine according to claim 10 wherein the inclined angle is 15°.

12. In a lump peat machine which mills peat from a peat bog comprising a rotating milling cutter for cutting said peat, the cutter having a power source, said peat machine being adapted for coupling to motive means for driving the peat machine through the peat bog, said motive means having a throttle for adjusting its speed, the improvement comprising providing means for coupling the cutter to the motive means through an elastic member which engages in length to permit the distance between the cutter and said motive means to change from an original distance when said milling cutter meets increased resistance, said elastic member being operatively connected to said throttle whereby the throttle is displaced from a previously fixed position when the milling cutter meets increased resistance and the elastic member changes in length to reduce the speed of or halt said motive means, said elastic member being adapted to cause said cutter to move to restore the original distance between the cutter and the motive means when said motive means has been slowed or halted by operation of said elastic member until said increased resistance has been overcome and whereby said throttle is returned to said predetermined position.

13. A lump peat machine according to claim 12 wherein said elastic member is a helical spring.

14. A lump peat machine according to claim 12 wherein the milling cutter is connected to the power source through a hydraulic transmission adapted to permit the milling cutter to stop abruptly when it encounters excessive resistance while permitting said power source to continue generating power.

15. A lump peat machine according to claim 14 wherein the elastic member is a helical spring.

16. A lump peat machine according to claim 14 wherein said power source is a machine towed by said lump peat machine.

17. A lump peat machine according to claim 12 wherein said motive means is a machine that tows said lump peat machine and said elastic member increases in length when said milling cutter meets increased resistance.

18. A lump peat machine according to claim 12 comprising a support member for said milling cutter and means for raising and lowering the support member to move said milling cutter between a working position and a transport position.

19. A lump peat machine according to claim 18 wherein the means for raising and lowering said support member is a hydraulic cylinder.

20. A lump peat machine according to claim 19 wherein said motive means is a machine for towing said lump peat machine and the member elastically coupling said lump peat machine to said motive means is pivotably connected to the support member for said milling cutter.

21. A lump peat machine according to claim 20 wherein said elastic member is a helical spring that increases in length when the milling cutter meets increased resistance.

* * * * *